US006084533A

United States Patent [19]

Morgan et al.

[11] Patent Number: 6,084,533

[45] Date of Patent: Jul. 4, 2000

[54] DIRECTIONAL TRAFFIC SENSOR SYSTEM

[75] Inventors: J. Derald Morgan; Steven J. Durand, both of Las Cruces, N. Mex.

[73] Assignee: New Mexico State University Technology Transfer Corporation, Las Cruces, N. Mex.

[21] Appl. No.: 09/032,163

[22] Filed: Feb. 26, 1998

Related U.S. Application Data

[60] Provisional application No. 60/039,677, Feb. 28, 1997.

[51] Int. Cl.[7] ..... G08G 1/01

[52] U.S. Cl. ..... 340/935; 340/933; 340/941; 340/907

[58] Field of Search ..... 340/935, 934, 340/936, 933, 941, 905, 907; 701/117, 118, 119

[56] References Cited

U.S. PATENT DOCUMENTS

| | | | |
|---|---|---|---|
| 1,610,692 | 12/1926 | Logwood . | |
| 2,532,231 | 11/1950 | Jarvis . | |
| 2,537,298 | 1/1951 | Baughman . | |
| 3,090,042 | 5/1963 | Kleist et al. . | |
| 3,536,900 | 10/1970 | Iwamoto et al. . | |
| 3,587,012 | 6/1971 | Pickarski . | |
| 3,588,805 | 6/1971 | Davin | 340/935 |
| 3,641,569 | 2/1972 | Bushnell et al. | 340/935 |
| 3,697,996 | 10/1972 | Elder et al. . | |
| 3,863,206 | 1/1975 | Rabie | 340/935 |
| 4,320,380 | 3/1982 | Berard | 340/935 |
| 5,313,200 | 5/1994 | Sone . | |
| 5,633,629 | 5/1997 | Hochsetin | 340/907 |

OTHER PUBLICATIONS

3M Installation Instructions for the CANOGA™ C400 "Vehicle Detection System", C424T Loop Detector.

3M brochure for the CANOGA™ C400 "Vehicle Detection System".

*Primary Examiner*—Julie Lieu

*Attorney, Agent, or Firm*—Jeffrey D. Myers; Deborah A. Peacock; Joseph Barrera

[57] ABSTRACT

A directional traffic sensing system and method employing one or more pairs of overlapping sensor loops, a sensing controller driving the sensor loops, interference minimization between the overlapping loops, direction of travel determination, and reduction of false directional reports.

18 Claims, 6 Drawing Sheets

DIRECTIONAL TRAFFIC SENSOR SYSTEM

This application claims the benefit of U.S. Provisional Application Ser. No. 60/039,677 Feb. 28, 1997.

CROSS-REFERENCE TO RELATED APPLICATIONS

This application claims the benefit of the filing of U.S. Provisional Patent Application Ser. No. 60/039,677, entitled Directional Traffic Sensor System, filed on Feb. 28, 1997, and the specification thereof is incorporated herein by reference.

GOVERNMENT RIGHTS

The U.S. Government has a paid-up license in this invention and the right in limited circumstances to require the patent owner to license others on reasonable terms.

BACKGROUND OF THE INVENTION

1. Field of the Invention (Technical Field)

The present invention relates to systems and apparatuses for detecting passage of vehicles and directions of travel thereof.

2. Background Art

A major cause of high speed collisions and concomitant traffic fatalities and serious injuries is the passage of traffic in the wrong direction in a one-way lane. Especially for lanes having a history of accidents due to wrong-way traffic, it is desirable to deploy a robust and substantially error-free system of dynamically warning of wrong-way traffic. Both the wrong-way vehicle and vehicles proceeding correctly must be warned. The present invention provides such a system.

Related attempts at accurate traffic detection have suffered various flaws. U.S. Pat. No. 3,641,569, to Bushnell et al., entitled "Highway Vehicle Sensor System", discloses a device for detecting direction of travel requiring sets of three loops, each set with a main loop and two probe loops. U.S. Pat. No. 3,863,206, to Rabie, entitled "Digital Vehicle Detector", discloses the use of overlapping pairs of loops and sequentially cyclically energizing different-frequency oscillators, but does not appear to provide for detection of direction of travel. U.S. Pat. No. 4,320,380, to Berard et al., entitled "Electronically Controlled Safety Mechanism for Highway Exit Ramp", discloses wrong-way detection and warning using loop detectors, but does not provide for overlap of such loops.

Patents related to the subject matter of this invention but not believed particularly significant include U.S. Pat. No. 3,697,996, to Elder et al., entitled "Electromagnetic Field Producing Apparatus and Method for Sequentially Producing a Plurality of Fields"; U.S. Pat. No. 3,588,805, to Davin, entitled "Highway Intersection Warning System"; U.S. Pat. No. 3,587,012, to Pickarsky, entitled "Magnetically Actuated Detecting and Switching Device"; U.S. Pat. No. 3,536,900, to Iwamoto et al., entitled "Apparatus for Detecting Traffic Delay"; U.S. Pat. No. 3,090,042, to Kleist et al., entitled "Interrogator-Responder Signalling System"; U.S. Pat. No. 2,537,298, to Baughman, entitled "Traffic Controlling Apparatus"; U.S. Pat. No. 2,532,231, to Jarvis, entitled "Traffic Detector"; and U.S. Pat. No. 1,610,692, to Logwood, entitled "Railroad Signaling System".

SUMMARY OF THE INVENTION (DISCLOSURE OF THE INVENTION)

The present invention is of a directional traffic sensing method and system comprising: providing one or more pairs of overlapping sensor loops; supplying a sensing controller driving the sensor loops; minimizing interference between the overlapping sensor loops; determining direction of travel of vehicles passing over the overlapping sensor loops; and reducing false directional reports by the controller. In the preferred embodiment, the sensor loops are overlapped in their pairs over approximately one-half the width of the sensor loops. Minimizing may be by continuous excitation at two separate frequencies, sequential excitation, or continuous excitation at a single frequency via discrete loop impedance discriminators. Direction of travel is determined by detecting vehicle presence at edges of the sensor loops. Reducing is done by ignoring reports concerning vehicles traveling slower than a first predetermined speed or faster than a second predetermined speed. One or more warning devices are activated to alert vehicle drivers traveling in at least two directions. The connection may be accomplished by electromagnetic communication connecting the controller with the warning device. It is preferred to use an uninterruptable power supply. The system may be employed to count numbers of vehicles passing over the overlapping loops in each of a plurality of directions and dynamically changing the direction of lawful traffic passing over the overlapping loops.

A primary object of the present invention is to provide a directional traffic sensing system which minimizes false positives without compromising safety.

A primary advantage of the present invention is its ability to be used for both wrong-way traffic detection and warning as well as traffic counting for bidirectional lanes (such as the central lane through the tunnel between Walnut Creek and Oakland, Calif.).

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

Figure 1:
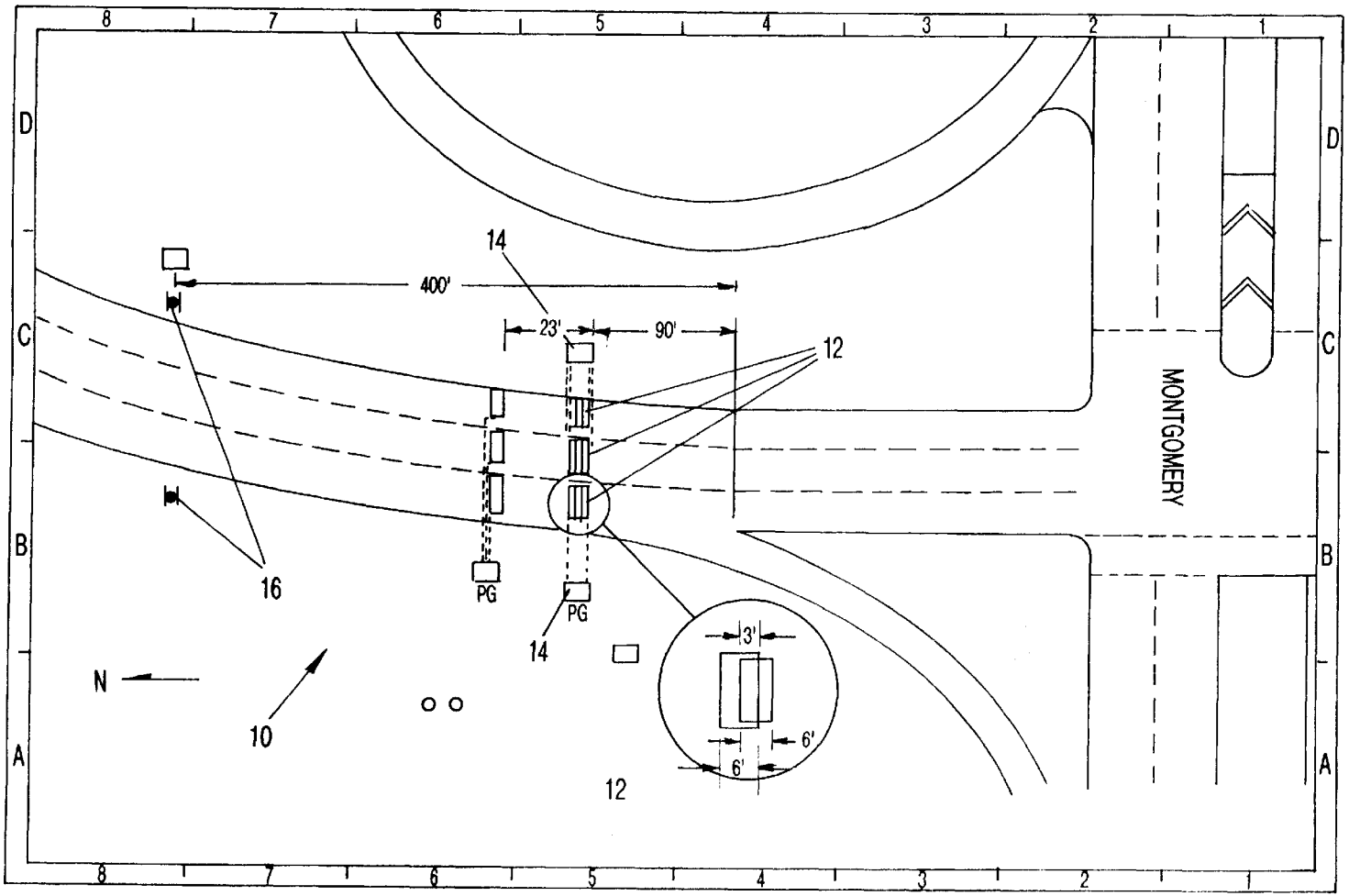
FIG. 1 illustrates a three-lane embodiment of the present invention as discussed in Example 1.

DESCRIPTION OF THE PREFERRED EMBODIMENTS (BEST MODES FOR CARRYING OUT THE INVENTION)

The present invention is of a directional traffic sensor (DTS) system 10 preferably comprising a plurality of loop sensors 12, a vehicle detection unit 14, and highway warning signs 16. A modem 18 is preferably employed to transmit data.

Figure 2:
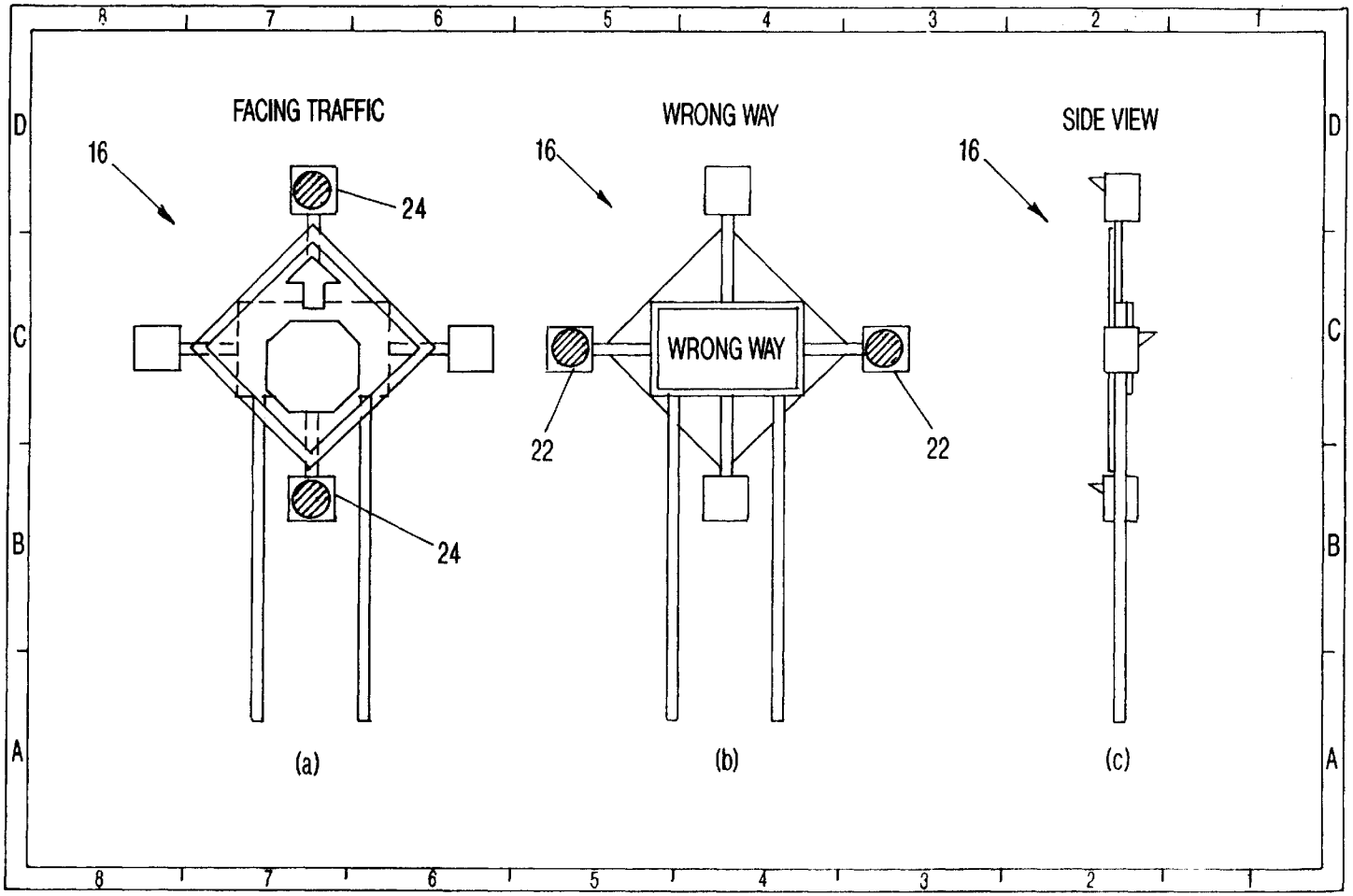
FIGS. 2(*a*)–(*c*) illustrate the preferred combination wrong-way/stop warning sign of the invention, with FIG. 2(*a*) being the facing traffic view, FIG. 2(*b*) being the wrong-way view, and FIG. 2(*c*) being a side view.
Figure 4:
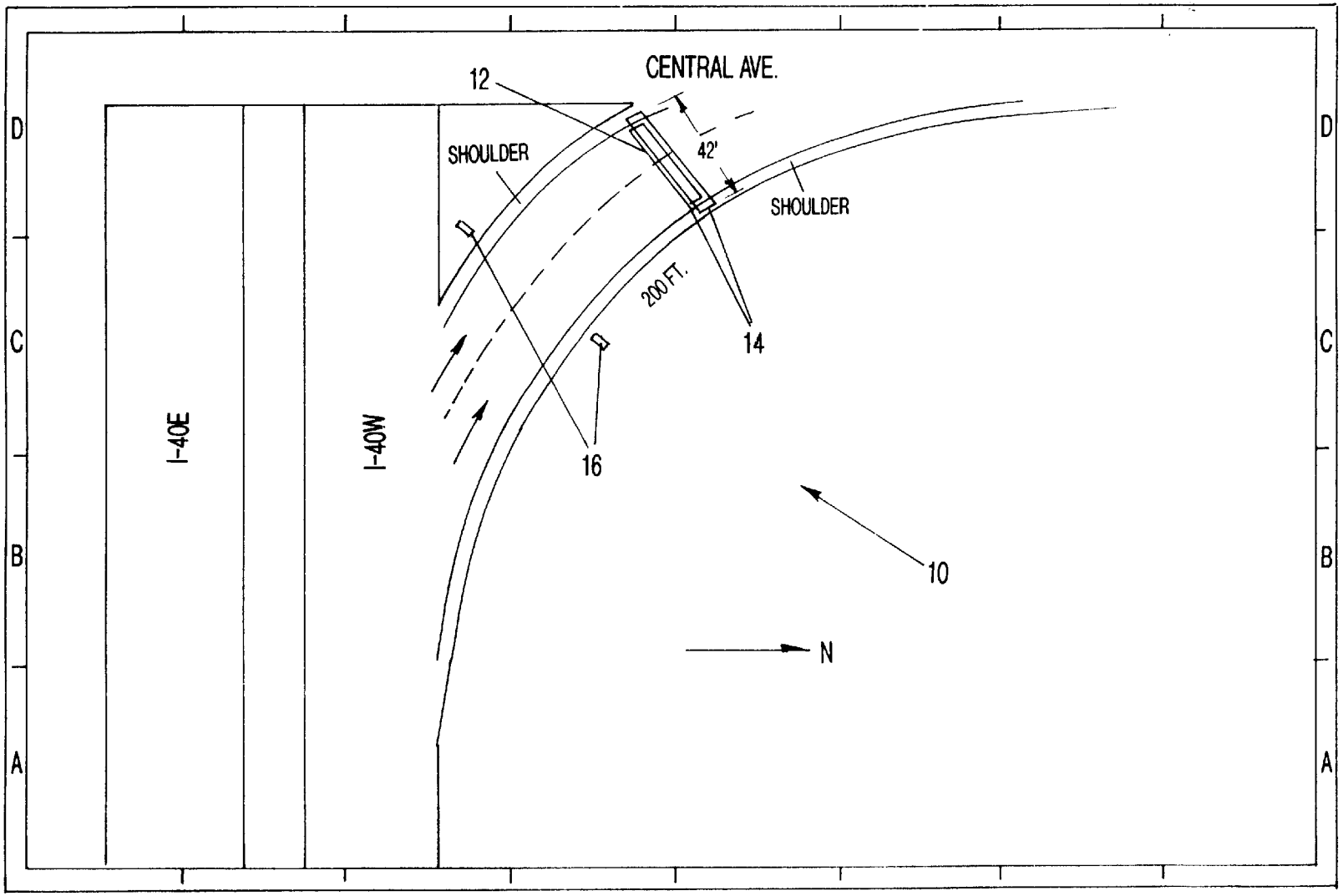
FIG. 4 illustrates a dual-lane off-ramp embodiment of the invention.

One application for the DTS system of the invention is freeway off-ramp wrong-way detection and warning (see FIG. 4). When wrong-way traffic is detected entering the off-ramp, the DTS illuminates two sets of warning lights. Each set will flash for a period, preferably one minute. Referring to FIG. 2, a red set 22 faces the wrong-way traffic, warning the driver of imminent danger. A yellow set 24 faces the exiting freeway traffic and warns the traffic of a possible on-ramp obstacle. This configuration is an effective warning device in bad weather conditions and is also effective with disoriented and confused drivers.

Figure 3:
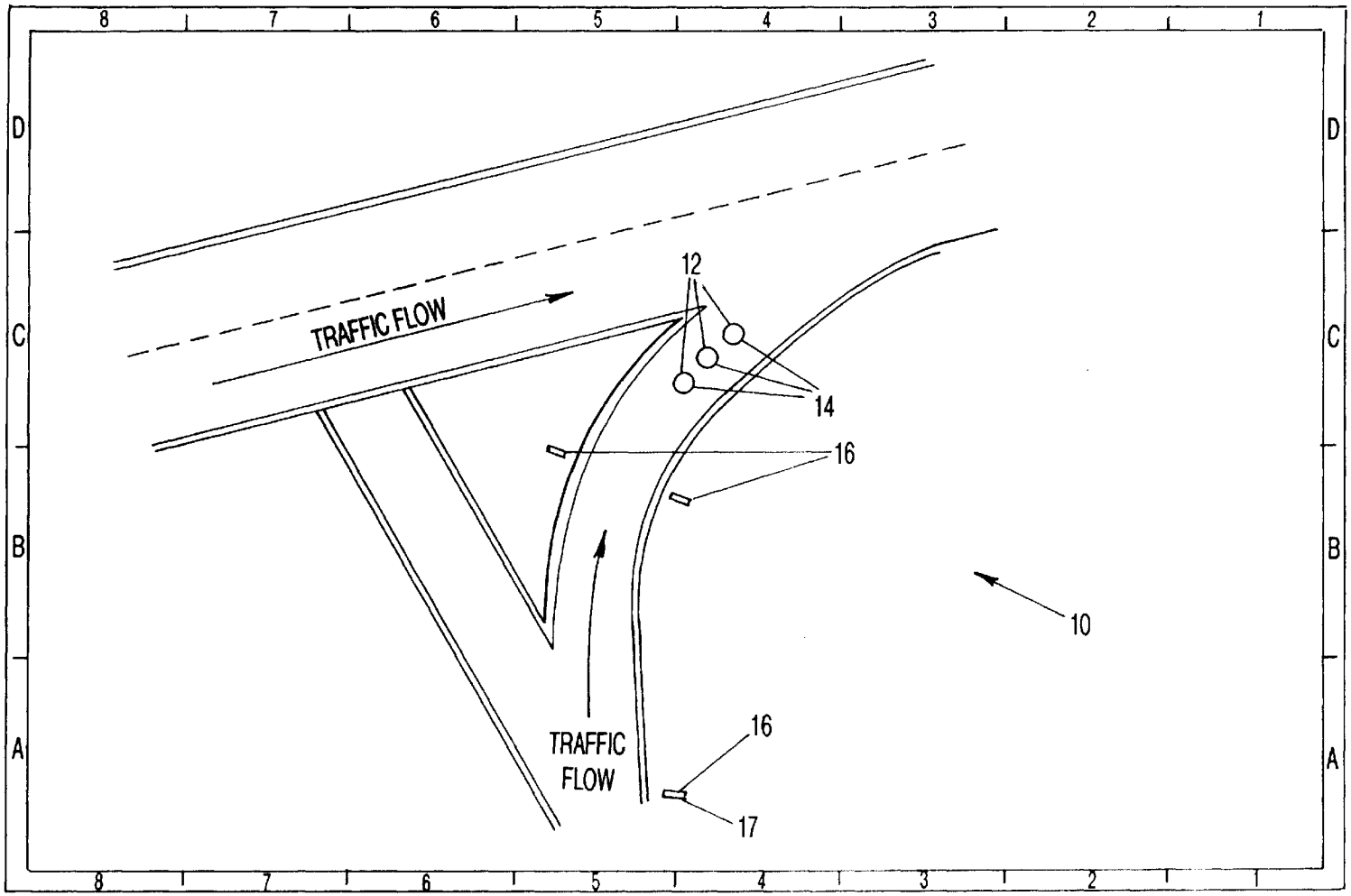
FIG. 3 illustrates a single-lane on-ramp embodiment of the invention.

A second application is freeway on-ramp wrong-way detection and warning (see FIG. 3). This configuration adds an "On-Ramp Closed" warning sign 17 at the entrance to the on-ramp. This will light when the two principal warning signs are lit.

A third application for the DTS system of the present invention is vehicle counting in bi-directional lanes (not shown). The system provides total traffic counts in each direction, and can be used to control decisions when to switch lane directionality, either by studies over a period of time or dynamically on a daily basis.

The DTS system loops are installed in an overlapping configuration. For example, the loops in FIG. 1 are each six feet wide and overlap over three feet. This configuration allows the DTS system to accurately detect vehicle direction. Valid counts in either direction are tallied when vehicles cross the loops at speeds between 5 and 150 mph. This windowing technique reduces the number of false tallies.

The preferred vehicle detector to be used with the invention is a modified 3M Canoga™ C400 Vehicle Detector (see "Installation Instructions: Canoga™ C400 Vehicle Detection System: C424T Loop Detector" (date unknown) and "Canoga™ C400 Vehicle Detection System: Technology and Performance You Can Count On" (date unknown)). The preferred 3M Canoga™ Detector is a multi-lane traffic counter with modem capability. Traditionally, this detector uses loops placed one per lane, no closer than 20 feet apart. The Canoga™ Detector reduces lane-to-lane loop interference by sequential-loop excitation. The Canoga™ Detector excites loops sequentially at about 2 kHz. A short burst of 20 to 40 cycles excites the loop, the impedance is determined, and the next loop is excited. Vehicle presence results in a measurable loop impedance change. 3M sometimes uses the Canoga™ Detector to monitor vehicle speed. In this configuration, two 6-ft. long×10-ft. wide loops are installed in a single lane 20 to 60 feet apart. As a vehicle is detected over the first loop, a timer is started. When the vehicle is detected over the second loop, the timer is stopped and a vehicle speed is determined.

The present invention permits vehicle detectors to sense direction of travel by reducing spacing between the loops to less than the width of the loop. For example, this may be accomplished by overlapping two standard 6-ft. long loops by 3 feet. Various methods are available to enable loops to be overlapped without interference. The preferred 3M Canoga™ Vehicle Detector allows overlapping loops without loop-to-loop interference via a sequential-loop excitation technique. Other detectors may be employed if use is made of continuous excitation at two separate frequencies; sequential excitation (like the Canoga™ Detector approach); or continuous excitation with a single frequency with separate loop impedance discriminators.

The problem that needs to be solved in a wrong-way vehicle detection is how to detect direction allowing for all possible scenarios. It might appear that the task is easy (if a vehicle is detected over Loop A first, then Loop B second, it is traveling in direction A→B; if a vehicle is detected over Loop B first and then over Loop A, it is traveling in direction B→A), but if the loops are 60 feet apart, it is possible to have Loop A detect multiple vehicles before Loop B has detected one. The sequence produced from three close vehicles is A-A-A-B-B-B. If a fourth vehicle is detected over Loop A, the sequence becomes A-A-A-B-B-B-A. It is now difficult (if not impossible) to determine vehicle direction.

The present invention, in the preferred embodiment, places the edge of the loops three feet apart and is symmetrical from either direction. Prior vehicle circuit designs use "level detection" to recognize the presence of vehicles. The present invention employs "edge detection" by assuming the vehicles have no length and thus allows the loops to be installed in an overlapping configuration. The edge detection method of the present invention determines vehicle direction by Edge-A before Edge-B (A→B) and Edge-B before Edge-A to detect direction B→A. Signal processing hardware or software uses a windowing method to eliminate false events. A→B transitions have physical implications if the loops are three feet apart. When A→B transitions occur slower than 818 milliseconds, then the vehicle is traveling slower than 5 mph. Slow moving vehicles are not a wrong-way threat (an example is a vehicle rolling backwards at a traffic light). If the transition is faster than 27 milliseconds, then the vehicle is either traveling faster than 150 mph or the loops are being excited by non-vehicles (examples include lightning or electrical surges). Thus, the present invention eliminates the possibility of multiple vehicle interference, slow-speed vehicle false-detection, surge, and false trips. This method is independent of the loop excitation method employed, as long as vehicle detection is within a few feet, loop-to-loop.

An off-the-shelf Canoga™ detector must be modified in the preferred embodiment, which requires that the vehicle detector output a low-level signal for a period (e.g., one minute) if a wrong-way as detected. The hardware/software (electronics programming) in a standard Canoga detector is not capable of providing such output. A combination of external hardware and internal hardware/software modifications and electronic programming were employed to obtain the required signals, which is readily duplicated by one skilled in the art once the problem to be solved is presented.

The DTS system preferably employs an internal battery and dc-to-ac inverter. Preferably, an uninterruptible power supply (UPS) 52 supplies power to the system for up to two to three days without grid support. This feature allows the system to function during bad weather conditions when wrong-way incidents are most prevalent. This feature also allows remote off-grid application by accepting photovoltaic power without modifications.

Figure 5:
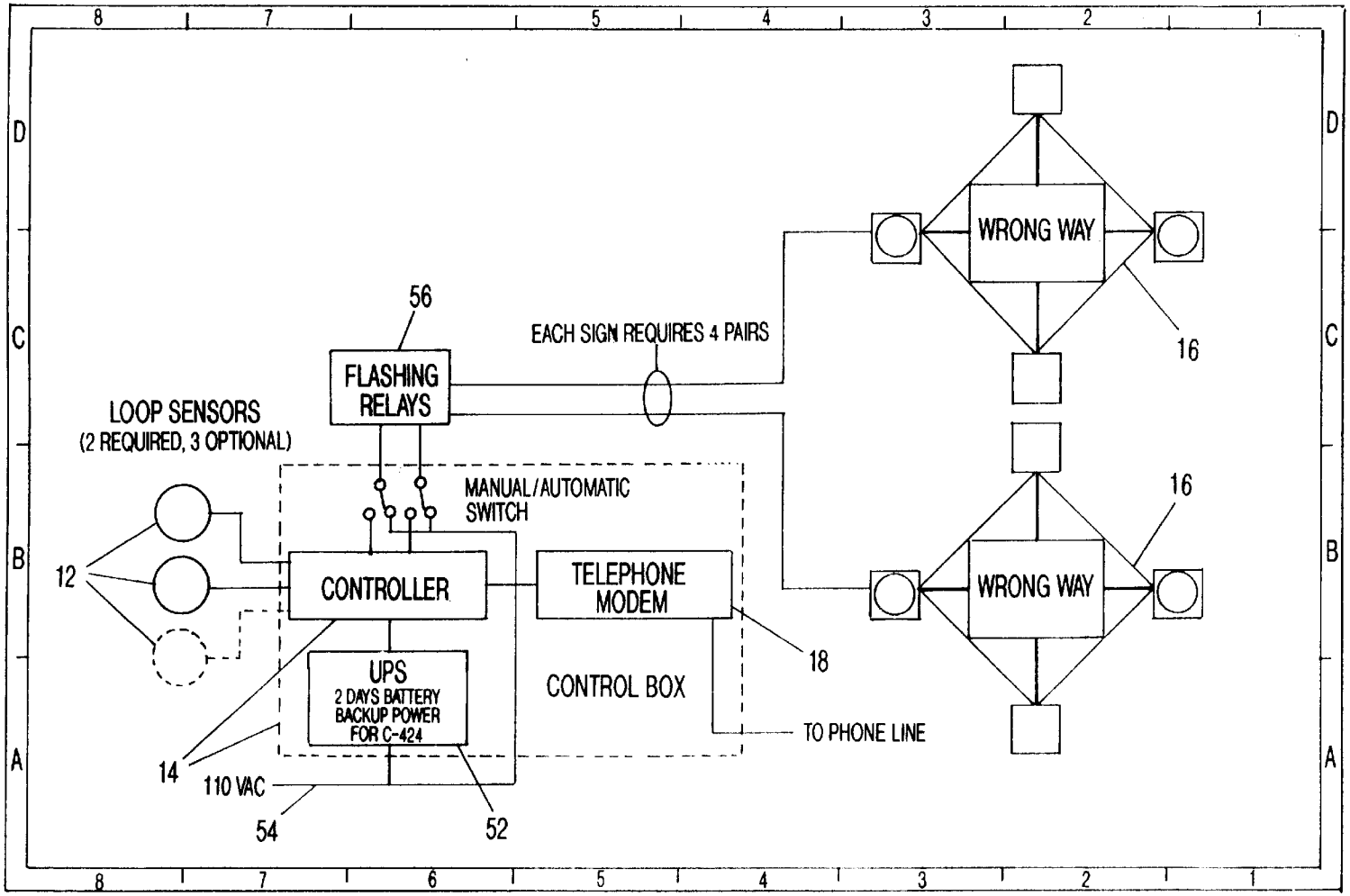
FIG. 5 is a schematic of the preferred embodiment of the invention with direct electrical connections to the warning signs.
Figure 6:
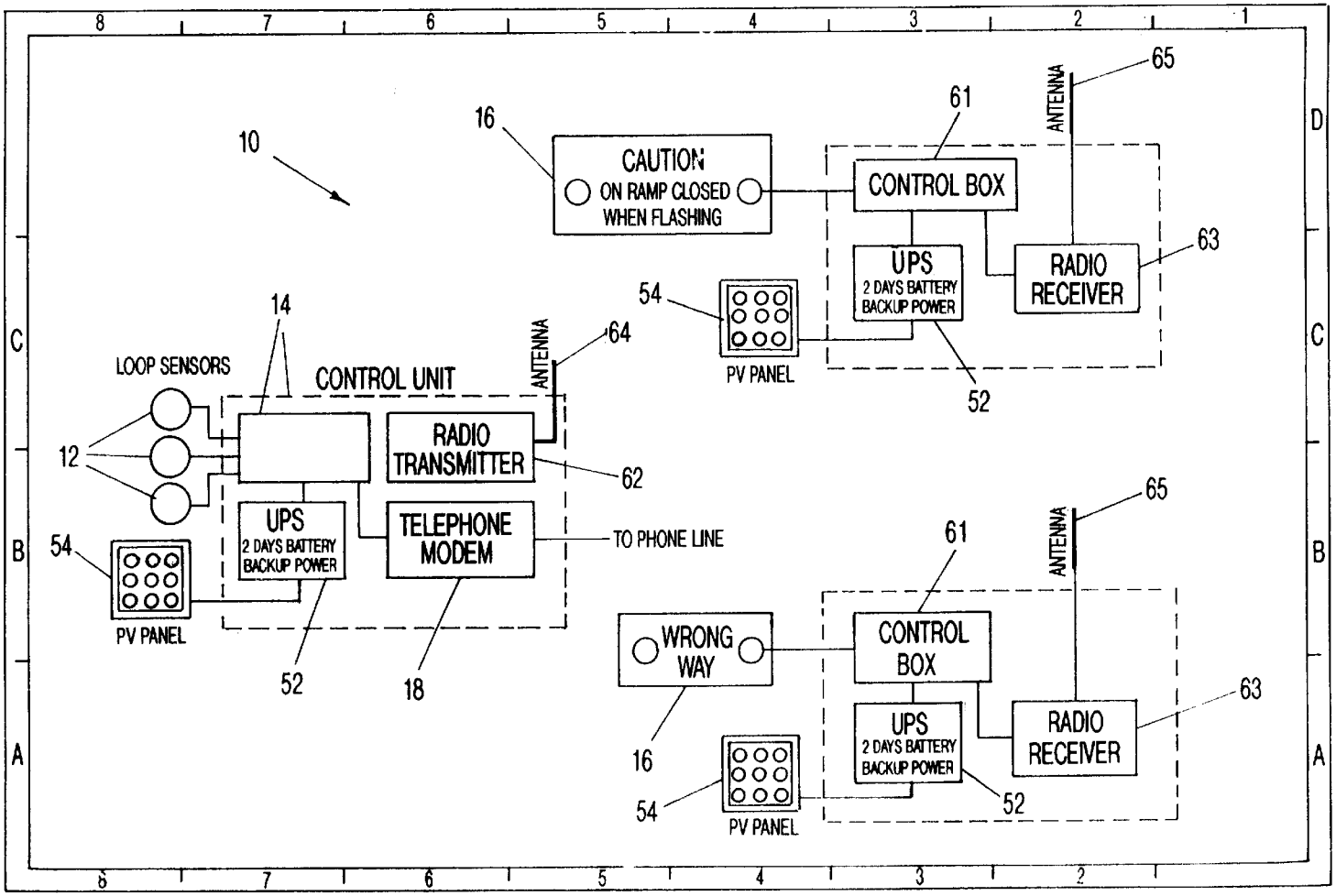
FIG. 6 is a schematic of an alternative embodiment of the invention employing radio waves to connect the vehicle detector to the warning signs.

Communication may occur between the controller 14 and the warning signs 16 in a number of manners. The two most preferred, depending on proximity of the signs to the controller, are shown in FIGS. 5 and 6. FIG. 5 employs flashing relays 56 to communicate over hard lines to the signs. FIG. 6 employs radio transmitter 62 and antenna 64 to communicate with sign control boxes 61 via radio receivers 63 and antennas 65.

The preferred embodiment of the DTS system of the invention comprises the following elements:

| | |
|---|---|
| Power source 54 | UPS 52 |
| 3M Canoga ™ detector 14 | Sensor cabinet (not shown) |
| 2 pairs of overlapping loops 12 | Warning lights 16 |
| Modem 18 | |

Industrial Applicability:

The invention is further illustrated by the following non-limiting example.

An embodiment of the present invention using double loop pairs in three adjacent lanes was placed to perform bi-directional independent counting of all three traffic lanes at the intersection of Montgomery and 1-25 in Albuquerque, N.Mex. (see FIG. 1). This configuration was chosen to test for loop-to-loop interference and adjacent lane interference, along with bi-directional vehicle counting.

Data collection from the detector started on June 11. The purpose of the monitoring was to determine the long-term reliability and performance of the detector. The data was collected once per week via telephone modem. A Visual Basic program was employed for this purpose. The Visual Basic program supported manual collection of total traffic counts in each direction as shown in Table 1.

TABLE 1

Traffic Count by Date, Lanes 1–3

| Date | Traffic Lane | Normal Counts | *Reverse | *Test Counts |
|---|---|---|---|---|
| 6/11/Reset Counter at 2:20 | | | | |
| 6/11/ | Lane 1 | 1,264 | 0 | 0 |
| | Lane 2 | 631 | 0 | 0 |
| | Lane 3 | 854 | 0 | 0 |
| 6/19/ | Lane 1 | 28,694 | 0 | 2 |
| | Lane 2 | 17,976 | 0 | 0 |
| | Lane 3 | 24,788 | 0 | 1 |
| 6/25/ | Lane 1 | 21,222 | 2 | 0 |
| | Lane 2 | 12,394 | 0 | 0 |
| | Lane 3 | 17,776 | 0 | 0 |
| 7/1/ | Lane 1 | 51,321 | 0 | 0 |
| | Lane 2 | 31,077 | 0 | 0 |
| | Lane 3 | 43,772 | 0 | 0 |
| 7/9/ | Lane 1 | 47,298 | 2 | 1 |
| | Lane 2 | 26,475 | 0 | 1 |
| | Lane 3 | 39,893 | 0 | 0 |
| 7/18/ | Lane 1 | 83,955 | 0 | 0 |
| | Lane 2 | 50,942 | 0 | 0 |
| | Lane 3 | 71,453 | 0 | 0 |
| 8/2/ | Lane 1 | 103,565 | 0 | 9 |
| | Lane 2 | 60,333 | 0 | 2 |
| | Lane 3 | 89,269 | 0 | 0 |
| 8/14/ | Lane 1 | 126,455 | 4 | 0 |
| | Lane 2 | 74,053 | 0 | 0 |
| | Lane 3 | 106,844 | 2 | 0 |
| 8/14/Reset Counter at 9:00 | | | | |
| 8/14/ | Lane 1 | 3 | 0 | 0 |
| | Lane 2 | 6 | 0 | 0 |
| | Lane 3 | 4 | 0 | 0 |
| 8/21/ | Lane 1 | 27,304 | 3 | 0 |
| | Lane 2 | 15,343 | 1 | 0 |
| | Lane 3 | 22,427 | 0 | 0 |
| TOTALS | | 1,197,391 | 14 | 16 |

A total of 1,197,391 forward traffic counts were obtained in a five-week period. During this same period, a total of 30 "wrong-way" traffic counts were obtained, 16 of which were scheduled tests. It is unknown whether the other 14 "wrong-way" traffic counts were actual events, false triggers, or undocumented staged events.

On July 25, a series of structured tests was performed. These tests were designed to test boundary and mode transition operation of the loops and detector.

Slow Speed Rejection. The detector was designed to ignore wrong-way traffic if the vehicle is traveling slower than 5 mph. This allows the detector to be installed on off-ramps were vehicles might naturally roll backwards during stopping and starting at the exit intersection. Multiple tests were performed at speeds between 3–5 mph. The results of the tests indicated that the detector was able to ignore wrong-way traffic below 5 mph and detect wrong-way traffic above 5 mph.

High Speed Rejection. The detector is also designed to ignore all traffic traveling faster than 150 mph. This feature was incorporated to limit the valid signal range. Proper implementation will eliminate false counts from near-by lightning strikes, electrical surges, and complex vehicle configurations. To simulate these types of error signals, both loops in a signal lane were entered at the same time. Multiple tests at speeds from 3 mph to over 25 mph were performed (Note: if the loops were actually entered at the exact same time, speed would be irrelevant). The detector successfully ignored all events.

Lane-to-Lane Interference. The detector configuration monitored traffic flow in three adjacent lanes. The detector was designed to reject adjacent-lane traffic. Multiple tests were performed, which included driving diagonally across the loops at speeds from 3 mph to 25 mph. No false indications were obtained during testing.

The preceding examples can be repeated with similar success by substituting the generically or specifically described reactants and/or operating conditions of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A directional traffic sensing system comprising:

one or more pairs of overlapping sensor loops;

a sensing controller driving said sensor loops;

means within said controller for minimizing interference between said overlapping sensor loops;

means within said controller for determining direction of travel of vehicles passing over said overlapping sensor loops;

means for reducing false directional reports by said controller; and means for ignoring reports concerning vehicles traveling slower than a predetermined speed.

2. The system of claim 1 wherein said overlapping sensor loops overlap over approximately one-half their width.

3. The system of claim 1 wherein said interference minimizing means comprises a means selected from the group consisting of means for providing continuous excitation at two separate frequencies, means for providing sequential excitation, and means for providing continuous excitation at a single frequency via discrete loop impedance discriminators.

4. The system of claim 1 wherein said means for determining direction of travel detects vehicle presence at edges of said sensor loops.

5. The system of claim 1 wherein said controller comprises means for activating a warning device alerting vehicle drivers traveling in a plurality of directions.

6. The system of claim 5 additionally comprising electromagnetic communication means connecting said controller with said warning device.

7. The system of claim 1 additionally comprising an uninterruptable power supply providing power to said system.

8. A directional traffic sensing system comprising:

one or more pairs of overlapping sensor loops;

a sensing controller driving said sensor loops;

means within said controller for minimizing interference between said overlapping sensor loops;

means within said controller for determining direction of travel of vehicles passing over said overlapping sensor loops;

means for reducing false directional reports by said controller; and means for ignoring reports concerning vehicles traveling faster than a predetermined speed.

9. A directional traffic sensing system comprising:

one or more pairs of overlapping sensor loops;

a sensing controller driving said sensor loops;

means within said controller for minimizing interference between said overlapping sensor loops;

means within said controller for determining direction of travel of vehicles passing over said overlapping sensor loops;

means for reducing false directional reports by said controller;

means for counting numbers of vehicles passing over said overlapping loops in each of a plurality of directions; and means for dynamically changing a direction of lawful traffic passing over said overlapping loops.

10. A directional traffic sensing method comprising the steps of:

a) providing one or more pairs of overlapping sensor loops;

b) supplying a sensing controller driving the sensor loops;

c) minimizing interference between the overlapping sensor loops;

d) determining direction of travel of vehicles passing over the overlapping sensor loops;

e) reducing false directional reports by the controller; and f) ignoring reports concerning vehicles traveling slower than a predetermined speed.

11. The method of claim 10 wherein the providing step comprises overlapping sensor loop pairs over approximately one-half a width of the sensor loops.

12. The method of claim 10 wherein the minimizing step comprises performing a step selected from the group consisting of providing continuous excitation at two separate frequencies, providing sequential excitation, and providing continuous excitation at a single frequency via discrete loop impedance discriminators.

13. The method of claim 10 wherein the determining step comprises detecting vehicle presence at edges of the sensor loops.

14. The method of claim 10 additionally comprising the step of activating a warning device alerting vehicle drivers traveling in a plurality of directions.

15. The method of claim 14 wherein the activating step comprises activating by electromagnetic communication means connecting the controller with the warning device.

16. The method of claim 10 additionally comprising the step of providing an uninterruptable power supply.

17. A directional traffic sensing method comprising the steps of:

a) providing one or more pairs of overlapping sensor loops;

b) supplying a sensing controller driving the sensor loops;

c) minimizing interference between the overlapping sensor loops;

d) determining direction of travel of vehicles passing over the overlapping sensor loops;

e) reducing false directional reports by the controller; and f) ignoring reports concerning vehicles traveling faster than a predetermined speed.

18. A directional traffic sensing method comprising the steps of:

a) providing one or more pairs of overlapping sensor loops;

b) supplying a sensing controller driving the sensor loops;

c) minimizing interference between the overlapping sensor loops;

d) determining direction of travel of vehicles passing over the overlapping sensor loops;

e) reducing false directional reports by the controller;

f) counting numbers of vehicles passing over said overlapping loops in each of a plurality of directions; and g) dynamically changing a direction of lawful traffic passing over said over lapping loops.

* * * * *